US011896122B1

(12) United States Patent
Mei

(10) Patent No.: US 11,896,122 B1
(45) Date of Patent: Feb. 13, 2024

(54) MOUNTING STRUCTURE OF STORAGE BASKET AND MULTI-LAYER STORAGE RACK WITH THE SAME

(71) Applicant: Dongguan Lingquan Hardware products co. LTD, Dongguan (CN)

(72) Inventor: Chengxian Mei, Dongguan (CN)

( * ) Notice: Subject to any disclaimer, the term of this patent is extended or adjusted under 35 U.S.C. 154(b) by 0 days.

(21) Appl. No.: 18/336,523

(22) Filed: Jun. 16, 2023

(30) Foreign Application Priority Data

Feb. 27, 2023 (CN) ..... 202320345853.3

(51) Int. Cl.
*A47B 57/54* (2006.01)
*A47B 57/56* (2006.01)

(52) U.S. Cl.
CPC ..... *A47B 57/54* (2013.01); *A47B 57/56* (2013.01)

(58) Field of Classification Search
CPC ..... A47B 57/54; A47B 57/545; A47B 57/56; A47B 57/562; A47B 57/565; A47B 57/567
See application file for complete search history.

(56) References Cited

U.S. PATENT DOCUMENTS 3,479,990 A * 11/1969 Crow ..... A01K 15/024 248/200.1
5,671,579 A * 9/1997 Miranda Camino ..... E04H 1/1272 52/646
7,186,050 B2 * 3/2007 Dean ..... F16B 7/0413 403/379.6
9,107,496 B2 * 8/2015 Lindo ..... A47K 3/281
9,693,660 B1 * 7/2017 Stelmarski ..... A47K 3/281
10,595,683 B1 * 3/2020 Stelmarski ..... A47K 3/281
10,655,781 B2 5/2020 Huang
11,330,902 B2 * 5/2022 Woo ..... A47B 96/14
2012/0217215 A1 * 8/2012 Emery ..... A47K 3/281 24/570
2022/0160123 A1 * 5/2022 Scanlon ..... A47K 3/281

FOREIGN PATENT DOCUMENTS

CN 213882989 8/2021
CN 216854177 7/2022
DE 102004054949 A1 * 5/2006 ..... A47B 21/0314
EP 1656854 A1 * 5/2006 ..... A47B 21/0314
EP 1961330 A1 * 8/2008 ..... A47B 57/54
KR 20040027622 A * 4/2004
KR 20070109806 A * 11/2007
KR 100909253 B1 * 7/2009
KR 20100000963 U * 1/2010

(Continued)

*Primary Examiner* — Stanton L Krycinski

(57) ABSTRACT

A mounting structure of a storage basket includes a post and a plug-in assembly connecting the post to the storage basket; the plug-in assembly includes a plug-in tube and a fitting tube sleeved outside the post, the plug-in tube is detachably sleeved outside the fitting tube to squeeze the fitting tube to tightly embrace the post and fixed; the plug-in tube is provided with a first plug-in portion, the storage basket is provided with a second plug-in portion, and the first plug-in portion and the second plug-in portion cooperate to insert, thereby installing the storage basket on the plug-in tube. Users can install and disassemble the storage rack through simple plugging, the mounting structure has a simple structure and a stable installation.

9 Claims, 5 Drawing Sheets

(56) References Cited

FOREIGN PATENT DOCUMENTS

| | | | | |
|---|---|---|---|---|
| KR | 20100109582 | A | * | 10/2010 |
| KR | 200456793 | Y1 | * | 11/2011 |
| KR | 200470966 | Y1 | * | 1/2014 |
| KR | 20140004726 | U | * | 8/2014 |

* cited by examiner

MOUNTING STRUCTURE OF STORAGE BASKET AND MULTI-LAYER STORAGE RACK WITH THE SAME

TECHNICAL FIELD

The present invention relates to a technical field of storage rack, more particularly to a mounting structure of a storage basket and a multi-layer storage rack with the same.

BACKGROUND

The storage rack is a kind of rack consisting of baskets or laminates with posts to place miscellaneous items, the posts used for supporting, and the baskets or the laminates used for bearing. The open-styled design makes the miscellaneous items visible at a glance, making it a good helper for storing household items and small items.

The most important structure of the storage rack is how to connect the baskets or the laminates with the posts. Chinese patent No. : CN 1009567435 A discloses a multi-function storage rack with a fixed clamp. The multi-function storage rack includes a fixed clamp and a post connected with a drain pan at the bottom thereof. The fixed clamp and the posts are formed in an integral at both sides of the edge of the storage rack, thereby the process that the edge of the post connects the fixed clamp is not necessary, the storage rack and the post can be assembled and disassembled simply and stably, and a connecting part is used at a bottom of the storage rack to connect a drain pan, it can be used as a bathroom storage rack in the bathroom or a tableware drain rack in the kitchen.

However, the fixed clamp disclosed in Chinese patent No. : CN 1009567435 A has a complex structure, and the connection with the post is not stable, the assembling and the disassembling are not convenient. Therefore, it is necessary to develop a new mounting structure to connect the baskets or the laminates with the post, thereby simply assembling and disassembling.

SUMMARY

In order to overcome the deficiencies of the prior art, the present invention provides a mounting structure and multi-layer storage rack with the same, which has a simple structure and is easy to assemble and disassemble the storage rack, stable, and convenient to use.

The technical schemes are as follows:

A mounting structure of a storage basket includes a post, and a plug-in assembly connecting the post with the storage basket. The plug-in assembly includes a plug-in tube and a fitting tube, and the fitting tube is arranged outside the post, the plug-in tube is detachably sleeved outside the fitting tube, and the fitting tube is squeezed to tightly embrace the post and to be fixed. The plug-in tube is provided with a first plug-in portion, the storage basket is provided with a second plug-in portion. The first plug-in portion and the second plug-in portion cooperate to insert, thereby installing the storage basket on the plug-in tube.

An outer wall in the middle of the fitting tube is provided with external threads, and the top of the fitting tube is provided with several notches. The notches divide the top of the fitting tube into several independent plug-in pieces. Each of the plug-in pieces is provided with a bump, the thickness of the bump gradually increases downwards from the top of each of the plug-in pieces. The inner wall of the plug-in tube is provided with internal threads, the plug-in tube is sleeved outside the fitting tube from the top thereof so that the top of the fitting tube is accommodated in the plug-in tube, the internal threads cooperate with the external threads, thereby realizing the detachable installation of the plug-in tube and the fitting tube. The inner wall of the plug-in tube squeezes the bumps on the plug-in pieces so that the plug-in pieces tightly embrace the post, thereby fixing the plug-in assembly on the post.

The bottom of the fitting tube is exposed outside the plug-in tube.

Preferably, the plug-in assembly also includes a fitting ring, the fitting ring is sleeved outside the plug-in pieces, lying between the bumps of the plug-in pieces and the external threads of the fitting tube.

The first plug-in portion is two symmetrical slots protruding outward from an outer wall of the plug-in tube, and the second plug-in portion is two insertion pieces arranged on the storage basket, and the insertion pieces are respectively inserted into the two symmetrical slots.

Preferably, a wall of each of the two symmetrical slots is provided with a baffle, a receiving slot is formed between the baffle and the outer wall of the plug-in tube; each of the inserting pieces consists of a horizontal piece and a vertical piece arranged in a T shape, the vertical piece is inserted into one of the two symmetrical slots, and the horizontal piece is accommodated in the receiving slot.

The storage basket is designed as a basket or a layered board.

A multi-layer storage rack includes the above-described mounting structure and a post assembly, the post assembly includes the several above-described posts, an upper tube end, and a lower tube end, each of the posts has a main body, and a large end and a small end relatively arranged at both ends of the main body. The diameter of the large end is equal to that of the main body, the large end is provided with a first thread, the diameter of the small end is less than that of the main body, the small end is provided with a second thread, when two of the post are connected, the small end of one is inserted into the large end of the other, and the two are threaded together.

The upper tube end and the lower tube end are respectively connected with both ends of the post assembly. The upper tube end has a top wall and an insertion tube arranged thereon, an inner diameter of the insertion tube matches the top end of the post located at the top of the post assembly. The lower tube is in a horn shape, which matches the bottom end of the post located at the bottom of the post assembly.

The lower tube end is provided with a counterweight block, and the counterweight block is provided with a screw. An internal locking tube is arranged between the post located at the bottom of the post assembly and the lower tube end, a bottom of the internal locking tube is provided with a threaded hole, and the screw is inserted into the threaded hole, thereby fixing the internal locking tube. An upper end of the internal locking tube is provided with a plastic lock, the internal locking tube is inserted into the large end of the post located at a bottom of the post assembly, and the large end of the post squeezes the plastic lock and the top end of the internal locking tube so that the post can not rotate.

The advantages of the present invention are as follows: in the mounting structure, and the fitting tube is sleeved outside of the post, the plug-in tube is detachably sleeved outside the fitting tube to squeeze the fitting tube to tightly embrace the post and fixed. The plug-in tube has the first plug-in portion, the storage basket is provided with a second plug-in portion, and the first plug-in portion and the second plug-in portion cooperate to insert, thereby installing the basket on the plug-in tube. Users can install and disassemble the storage rack through simple plugging, the mounting structure has a simple structure and a stable installation.

In the multi-layer storage rack, the users can choose the number of the post and the layers number of the multi-layer storage rack according to their desired highness, thereby satisfying different users' needs. In addition, the plug-in assembly can install at any position of the post, several of the plug-in assemblies can be installed according to the user's needs, making installation and disassembly extremely convenient. During storage and transportation, the multi-layer storage rack can be disassembled to packaged, occupying a small volume, facilitating storage and transportation, and reducing costs.

DETAILED DESCRIPTION OF EMBODIMENTS

For the purpose of the invention, the technical scheme and the technical effect are more clearly understood, and the invention will be further described in the following with reference to specific embodiments. It is to be understood that the specific embodiments described herein are for illustrative purposes only and are not intended to limit the invention.

Figure 1:
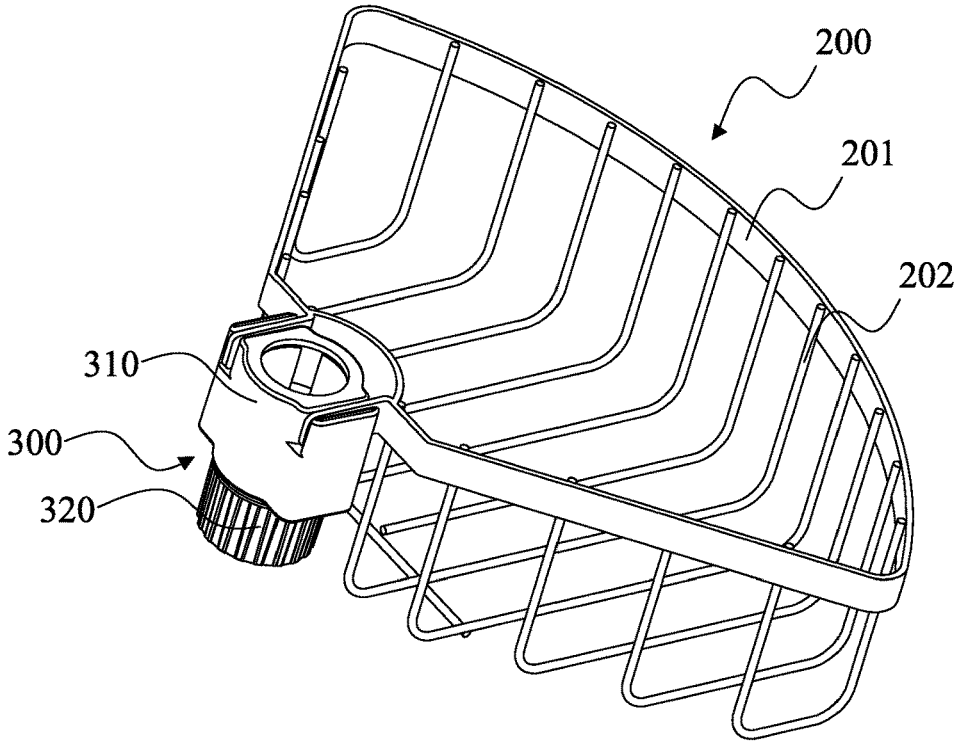
FIG. 1 is a perspective view of the mounting structure of the storage basket according to the embodiment in the present invention.
Figure 2:
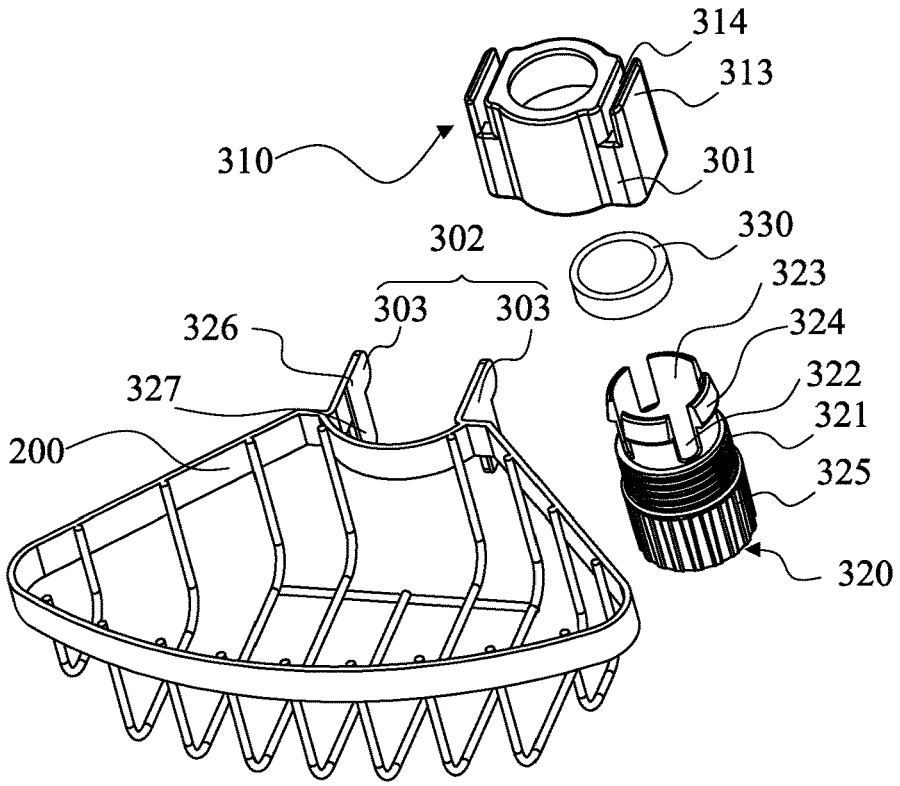
FIG. 2 is an exploded view of FIG. 1.
Figure 3:
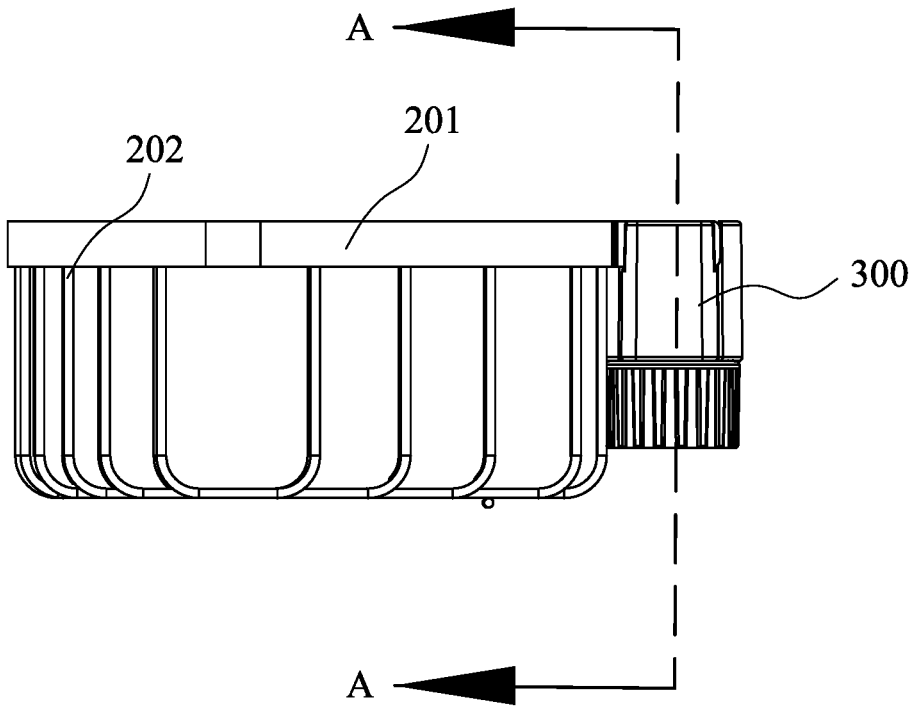
FIG. 3 is a front view of the mounting structure shown in FIG. 1.
Figure 4:
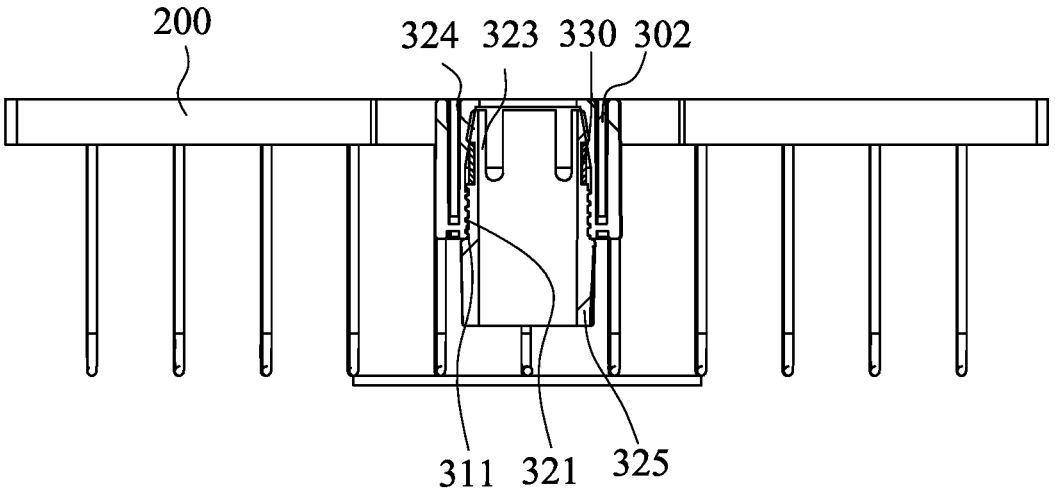
FIG. 4 is an in-section view along line A-A in FIG. 3.

Referring to FIG. 1, the present invention provides a mounting structure of a storage basket 200, which includes a post 100, and a plug-in assembly 300 connecting the post 100 with the storage basket 200. The plug-in assembly 300 includes a plug-in tube 310 and a fitting tube 320, the fitting tube 320 is arranged outside the post 100, and the plug-in tube 310 is detachably sleeved outside the fitting tube 320 to squeeze the fitting tube 320 to tightly embrace the post 100 and to be fixed. The plug-in tube 310 is provided with a first plug-in portion 301, the storage basket 200 is provided with a second plug-in portion 302, the first plug-in portion 301 and the second plug-in portion 302 cooperate to insert, thereby installing the storage basket 200 on the plug-in tube 310. With the mounting structure of the storage basket 200, the users can assemble and disassemble the storage basket 200 through simple insertion action. The mounting structure of the storage basket 200 has a simple structure and can realize stable installation.

An outer wall in the middle of the fitting tube 320 is provided with external threads 321, and the top of the fitting tube 320 is provided with several notches 322. The notches 322 divide the top of the fitting tube 320 into several independent plug-in pieces 323. Each of the plug-in pieces 323 is provided with a bump 324, the thickness of the bump 324 gradually increases downwards from the top of each of the plug-in pieces 323. When using, the fitting tube 320 is sleeved outside the post 100.

The inner wall of the plug-in tube 310 is provided with internal threads 311, the plug-in tube 310 is sleeved outside the fitting tube 320 from the top thereof so that the top of the fitting tube 320 is accommodated in the plug-in tube 310, the internal threads 311 cooperates with the external threads 321, thereby realizing the detachable installation of the plug-in tube 310 and the fitting tube 320. After installation, the inner wall of the plug-in tube 310 squeezes the bumps 324 on the plug-in pieces 323 so that the plug-in pieces 323 tightly embrace the post 100, thereby fixing the plug-in assembly 300 on the post 100.

The bottom of the fitting tube is exposed outside the plug-in tube. When adjusting the position of the plug-in assemble 300 installed on the post 100, simply press the bottom 325 of the fitting tube 320 to prevent it from rotating, then loosen the threads connection of the plug-in tube 310 and the fitting tube 320, so that the fitting tube 320 can be moved to the desired position along the post 100, then tighten the threaded connection of the plug-in tube 310 and the fitting tube 320 again, thereby facilitating the user to adjust the position of the plug-in assemble 300 installed on the post 100.

Preferably, the outer wall of the bottom 325 of the fitting tube 320 is provided with a pattern to increase the friction force when taking it.

Preferably, the plug-in assembly 300 also includes a fitting ring 330, sleeved outside the plug-in pieces 323, lying between the bumps 324 of the plug-in pieces 323 and the external threads 321 of the fitting tube 320. When the plug-in tube 310 and the fitting tube 320 are assembled, the plug-in tube 310 squeezes the fitting ring 330, and the fitting ring 330 squeezes the plug-in pieces 323 so that the plug-in pieces 323 tightly embrace the post 100, thus fixing the position of the plug-in assemble 300 installed on the post 100.

It should be understood that the outer diameter of the outer wall of the bottom 325 of the fitting tube 320 is slightly larger than that of the outer wall of the middle thereof, and the outer diameter of the outer wall of the middle is slightly larger than that of the outer wall of the top thereof, resulting in the overall stepped shape of the outer wall of the fitting tube 320.

The first plug-in portion 301 is two symmetrical slots protruding outward from the outer wall of the plug-in tube 310, and the second plug-in portion 302 is two insertion pieces 303 arranged on the storage basket 200, and the two insertion piece 303 are respectively inserted into the two symmetrical slots 311.

Preferably, the wall of each of the two symmetrical slots 311 is provided with a baffle 313, a receiving slot 314 is formed between the baffle 313 and the outer wall of the plug-in tube 310; each of the inserting pieces 303 consists of a horizontal piece 326 and a vertical piece 327 arranged in a T shape, the vertical piece 327 is inserted into one of the slots 311, and the horizontal piece 326 is accommodated in the receiving slot 314 so that the cooperation of the slots 311 and the inserting pieces 303 are more stable.

Figure 5:
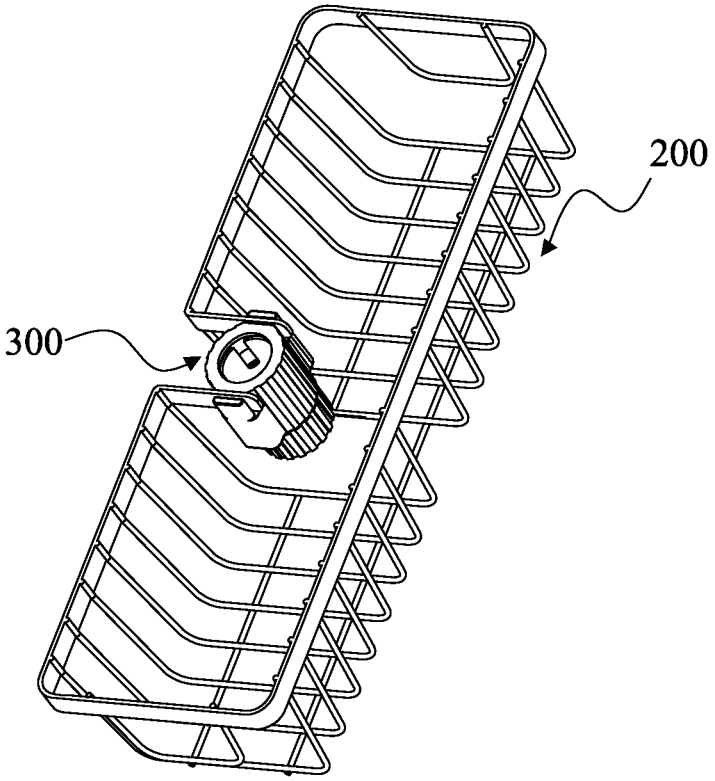
FIG. 5 is the other perspective view of the mounting structure according to the embodiment in the present invention.
Figure 6:
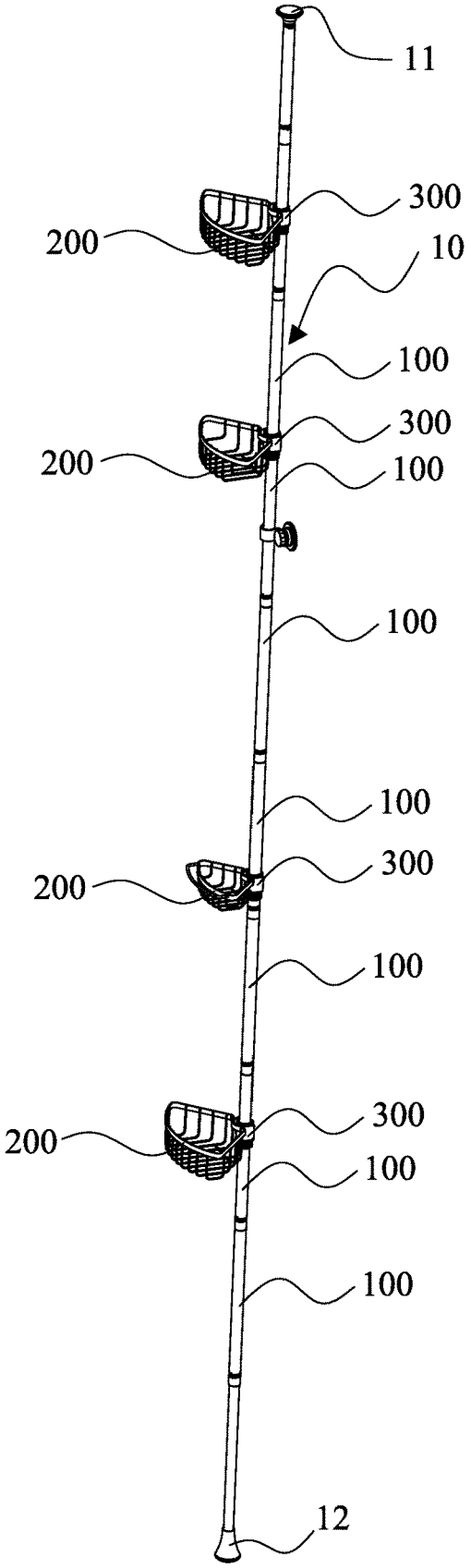
FIG. 6 is a perspective view of the multi-layer storage rack according to the embodiment in the present invention.
Figure 7:
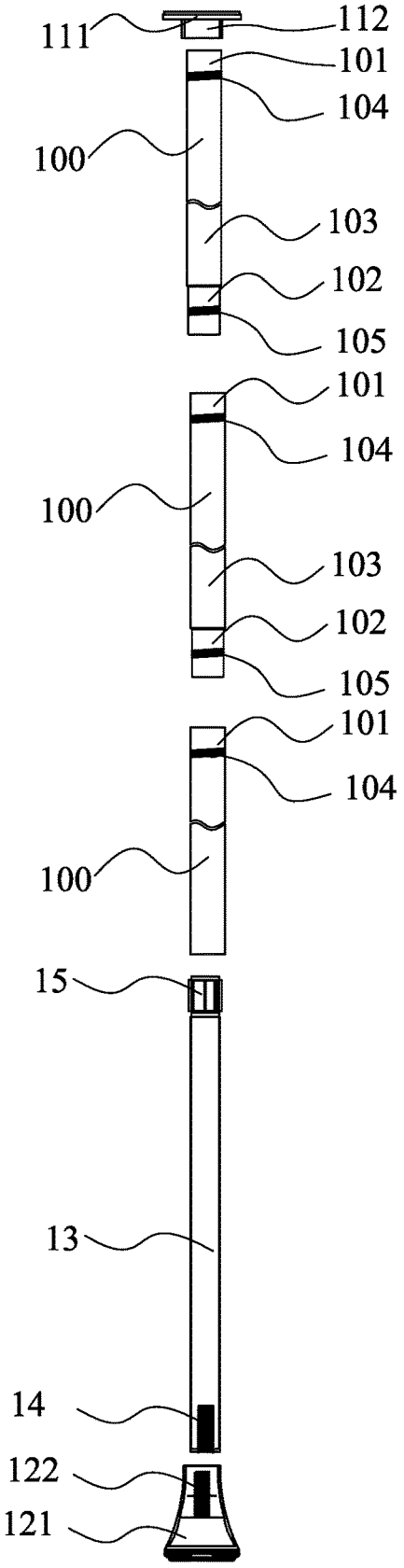
FIG. 7 is an exploded view of the multi-layer storage rack according to the embodiment in the present invention.

It should be understood that the structure and the shape of the storage basket 200 can be changed arbitrarily, it can be in a basket shape as shown in FIGS. 1 and 5, or a layered board. The storage basket 200 includes a frame 201 and multiple bars 202 arranged on the frame 201, thereby forming a storage space. The second plug-in portion 302 is mounted on the frame 201, the storage basket 200 can be in a triangular, quadrilateral, pentagon, semicircle shape, etc.

The present invention also provides a multi-layer storage rack, which includes the above-described mounting structure of the storage basket 200 and a post assembly 10, the post assembly 10 includes the several above-described posts 100, an upper tube end 11, and a lower tube end 12, each of the posts 100 has a main body 103, and a large end 101 and a small end 102 relatively arranged at both ends of the main body 101. The diameter of the large end 101 is equal to that of the main body 103, the large end 101 is provided with a first thread 104, the diameter of the small end 102 is less than that of the main body 103, the small end 102 is provided with a second threads 105, when two of the posts 100 are connected, the small end 102 of one is inserted into the large end 101 of the other, and the two are threaded together. This structure allows users to choose the number of the post 100 and the number of the storage basket 200 installed according to the actual height requirements, thereby adapting to the personalized needs of different users. In addition, the plug-in assembles 300 can be installed at any position of the post 100, and several of the plug-in assembles 300 can be installed according to user needs, making installation and disassembly extremely convenient. During storage and transportation, the plug-in assembles 300 can be disassembled and packaged, occupying a small volume, facilitating storage and transportation, and reducing costs.

The upper tube end 11 and the lower tube end 12 are respectively connected with both ends of the post assembly 10. The upper tube end 11 has a top wall 111 and an insertion tube 112 arranged thereon, an inner diameter of the insertion tube 112 matches the top end of the post 100 located at the topmost of the post assembly 10. The lower tube end 12 is in a horn shape, which matches the bottom end of the post 100 located at the bottommost of the post assembly 10.

In a preferred embodiment, the length of the topmost post 100 in the cylindrical tube assembly 10 is slightly smaller than that of the other posts 100, thereby making the multi-layer rack attractive appearance.

The lower tube end 112 is provided with a counterweight block 121, and the counterweight block 112 is provided with a screw 122. An internal locking tube 13 is arranged between the post 100 located at the bottom of the post assembly 10 and the lower tube end 12, a bottom of the internal locking tube 13 is provided with a threaded hole 14, the screw 122 is inserted into the threaded hole 14, thereby fixing the internal locking tube 13. An upper end of the internal locking tube 13 is provided with a plastic lock 15, the internal locking tube 13 is inserted into the large end of the post 100 located at the bottom of the post assembly 10, the large end of the post 100 squeezes the plastic lock 15 and the top end of the internal locking tube 13 so that the post 10 can not rotate. Thus after the multi-layer storage rack is assembled, the post assemble 10 can not rotate, which increases its stability.

The above is a further detailed description of the invention in combination with a specific preferred embodiment, and it can not be concluded that the specific implementation of the invention is limited to these instructions. For the general technical personnel in the technical field to which the invention belongs, without being separated from the conception of the invention, the architecture form can be flexible and changeable, and a series of products can be derived. If it is just making a number of simple deductions or substitutes should be regarded as falling within the scope of patent protection determined by the claim submitted by the present invention.

The invention claimed is:

1. A mounting structure of a storage basket, comprising a post and a plug-in assembly connecting said post to said storage basket; said plug-in assembly includes a plug-in tube and a fitting tube sleeved outside said post, said plug-in tube is detachably sleeved outside said fitting tube to squeeze said fitting tube to tightly embrace said post and to be fixed; said plug-in tube is provided with a first plug-in portion, said storage basket is provided with a second plug-in portion, said first plug-in portion and said second plug-in portion cooperate to insert, thereby installing said storage basket on said plug-in tube;

wherein an outer wall in a middle of said fitting tube is provided with external threads, a top of said fitting tube is provided with several notches; said notches divide said top of the fitting tube into several independent plug-in pieces; each of said plug-in pieces is provided with a bump, a thickness of said bump gradually increases downwards; an inner wall of said plug-in tube is provided with internal threads, said plug-in tube is sleeved outside said fitting tube from said top thereof so that said top of said fitting tube is accommodated in said plug-in tube, said internal threads cooperates with said external threads, thereby realizing a detachable installation of said plug-in tube and said fitting tube; said inner wall of the plug-in tube squeezes said bumps on said plug-in pieces so that said plug-in pieces tightly embrace said post, thereby fixing said plug-in assembly on said post.

2. The mounting structure of said storage basket according to claim 1, wherein a bottom of said fitting tube is exposed outside said plug-in tube.

3. The mounting structure of said storage basket according to claim 1, wherein said plug-in assembly also includes a fitting ring, sleeved outside said plug-in pieces, lying between said bumps of said plug-in pieces and said external threads of said fitting tube.

4. The mounting structure of said storage basket according to claim 1, wherein said first plug-in portion is two symmetrical slots protruding outward from an outer wall of said plug-in tube, and said second plug-in portion is two insertion pieces arranged on said storage basket, and said two insertion pieces are respectively inserted into said two symmetrical slots.

5. The mounting structure of said storage basket according to claim 4, wherein a wall of each of said two symmetrical slots is provided with a baffle, a receiving slot is formed between said baffle and said outer wall of said plug-in tube; each of said insertion pieces consists of a horizontal piece and a vertical piece arranged in a T shape, said vertical piece is inserted into one of said two symmetrical slots, and said horizontal piece is accommodated in said receiving slot.

6. The mounting structure of said storage basket according to claim 1, wherein said storage basket is a basket or a layered board.

7. A multi-layer storage rack comprising:

a mounting structure of a storage basket; and a post assembly;

said mounting structure of said storage basket comprising a post and a plug-in assembly connecting said post to said storage basket; said plug-in assembly includes a plug-in tube and a fitting tube sleeved outside said post, said plug-in tube is detachably sleeved outside said fitting tube to squeeze said fitting tube to tightly embrace said post and to be fixed; said plug-in tube is provided with a first plug-in portion, said storage basket is provided with a second plug-in portion, said first plug-in portion and said second plug-in portion cooperate to insert, thereby installing said storage basket on said plug-in tube;

wherein an outer wall in a middle of said fitting tube is provided with external threads, a top of said fitting tube is provided with several notches; said notches divide said top of the fitting tube into several independent plug-in pieces; each of said plug-in pieces is provided with a bump, a thickness of said bump gradually increases downwards; an inner wall of said plug-in tube is provided with internal threads, said plug-in tube is sleeved outside said fitting tube from said top thereof so that said top of said fitting tube is accommodated in said plug-in tube, said internal threads cooperates with said external threads, thereby realizing a detachable installation of said plug-in tube and said fitting tube; said inner wall of the plug-in tube squeezes said bumps on said plug-in pieces so that said plug-in pieces tightly embrace said post, thereby fixing said plug-in assembly on said post;

said post assembly comprising a plurality of said posts, an upper tube end, and a lower tube end; each of said posts has a main body, and a large end and a small end relatively arranged at both ends of said main body; a diameter of said large end is equal to that of said main body, said large end is provided with a first thread, a diameter of said small end is less than that of said main body, said small end is provided with a second thread, when two of said posts are connected, said small end of one is inserted into said large end of the other, and said two of said posts are threaded together.

8. The multi-layer storage rack according to claim 7, wherein said upper tube end and said lower tube end are respectively connected with both ends of said post assembly; said upper tube end has a top wall and an insertion tube arranged thereon, an inner diameter of said insertion tube matches a top end of said post located at a topmost of said post assembly; said lower tube is in a horn shape, matching a bottom end of said post located at a bottom of said post assembly.

9. The multi-layer storage rack according to claim 7, wherein said lower tube end is provided with a counterweight block with a screw; an internal locking tube is arranged between said post located at a bottom of said post assembly and said lower tube end, a bottom of said internal locking tube is provided with a threaded hole, said screw is inserted into said threaded hole, thereby fixing said internal locking tube; an upper end of said internal locking tube is provided with a plastic lock, said internal locking tube is inserted into said large end of said post located at a bottom of said post assembly, said large end of said post squeezes said plastic lock and said top end of said internal locking tube so that said post can not rotate.

* * * * *